US006069588A

United States Patent [19]

O'Neill, Jr.

[11] Patent Number: 6,069,588

[45] Date of Patent: May 30, 2000

[54] SYSTEMS AND METHODS FOR COAXIALLY COUPLING AN ANTENNA TO A RADIOTELEPHONE THROUGH A WINDOW AND AMPLIFYING SIGNALS ADJACENT AND INSIDE THE WINDOW

[75] Inventor: Gregory A. O'Neill, Jr., Apex, N.C.

[73] Assignee: Ericsson Inc., Research Triangle Park, N.C.

[21] Appl. No.: 09/248,434

[22] Filed: Feb. 11, 1999

[51] Int. Cl.[7] ..... H01Q 1/32

[52] U.S. Cl. ..... 343/713; 343/906

[58] Field of Search ..... 343/711, 712, 343/713, 715, 906; 333/24 C; 455/89, 90, 5.1, 86

[56] References Cited

U.S. PATENT DOCUMENTS

| | | | |
|---|---|---|---|
| 2,829,367 | 4/1958 | Rychlik | 343/850 |
| 4,621,243 | 11/1986 | Harada | 333/24 |
| 4,764,773 | 8/1988 | Larsen et al. | 343/713 |
| 4,839,660 | 6/1989 | Hadzoglou | 343/715 |
| 5,099,252 | 3/1992 | Bryant et al. | 343/713 |
| 5,155,494 | 10/1992 | Bryant et al. | 343/713 |
| 5,212,492 | 5/1993 | Jesman et al. | 343/713 |
| 5,451,966 | 9/1995 | Du et al. | 343/715 |
| 5,600,333 | 2/1997 | Justice et al. | 343/713 |
| 5,828,946 | 10/1998 | Feisullin et al. | 455/5.1 |

OTHER PUBLICATIONS

Haartsen, "*Bluetooth—The Universal Radio Interference For Ad Hoc, Wireless Connectivity*", Ericsson Review, No. 3, 1998, pp. 110–117.

Kraus, "*System Temperature and Signal–to–Noise Ratio*", Antennas, Second Edition, McGraw–Hill, 1988, pp. 782–787.

*Primary Examiner*—Tan Ho

*Attorney, Agent, or Firm*—Myers Bigel Sibley & Sajovec

[57] ABSTRACT

A through-the-window coaxial coupler coaxially couples Radio Frequency (RF) signals between the inside and outside surfaces of a window. The through-the-window coaxial coupler includes an inside portion that mounts on the inside surface of a window, and an outside portion that mounts on the outside surface of the window and couples to an outside antenna. An inside electronic package couples to the inside portion of the through-the-window coaxial coupler, and is located adjacent the inside portion and remote from a radiotelephone. The inside electronic package includes a receive amplifier that amplifies RF signals that are received from the outside antenna via the through-the-window coaxial coupler and that provides the RF signals so amplified to the radiotelephone. In another embodiment, the inside electronic package may include a wireless transceiver and that wirelessly transmits and receives signals to and from a radiotelephone. Thus, only power may need to be supplied to the electronic package, but signal and/or connections may be provided to the radiotelephone using wireless communications. One such wireless communications protocol that may be used is the well known "Bluetooth" protocol that defines a universal radio interface in the 2.45 GHz frequency band that enables wireless electronic devices to connect and communicate wirelessly via short-range, ad hoc networks.

11 Claims, 5 Drawing Sheets

SYSTEMS AND METHODS FOR COAXIALLY COUPLING AN ANTENNA TO A RADIOTELEPHONE THROUGH A WINDOW AND AMPLIFYING SIGNALS ADJACENT AND INSIDE THE WINDOW

CROSS-REFERENCE TO RELATED APPLICATION

This application is related to application Ser. No. 09/248,887 to the present inventor entitled "Systems and Methods for Coaxially Coupling an Antenna Through an Insulator", filed concurrently and assigned to the assignee of the present application, the disclosure of which is hereby incorporated herein by reference.

FIELD OF THE INVENTION

This invention relates to radiotelephone communications systems and methods, and more particularly to systems and methods for coupling antennas to radiotelephones.

BACKGROUND OF THE INVENTION

Radiotelephones are widely used for wireless voice and/or data communications. As used herein, the term "radiotelephone" includes analog and digital radiotelephones, multiple mode radiotelephones, high function Personal Communications Systems (PCS) devices that may include large displays, scanners, full size keyboards and the like, wireless Personal Digital Assistants (PDA) and other devices, such as personal computers that are equipped with wireless modems and other wireless electronic devices.

It may be increasingly difficult to efficiently couple an antenna to a radiotelephone transceiver. In particular, in many radiotelephone applications, the radiotelephone is located within an enclosure such as a vehicle or a building. However, it may be desirable to include the antenna outside the enclosure in order to provide adequate link margin. For example, in radiotelephone communications involving radio links between a mobile vehicle and a communication satellite, it is generally desirable for the antenna to be outside the vehicle. It is also generally desirable to have a radio frequency receiver unit near the antenna in order to allow an improved receiver antenna gain to receiver system temperature ratio. Moreover, as a practical matter, it also may be desirable to include a transmitter power amplifier near the antenna, to overcome transmission loss between the antenna and the transceiver.

It is known to provide an external electronic package or module adjacent an antenna outside a vehicle window, to thereby improve the performance of a radiotelephone within a vehicle. Unfortunately, external electronic packages may be subject to environmental hazards and damage by vandals. Other hazard potentials include automatic car washing facilities that can damage external electronic packages.

Moreover, it may be difficult to couple an electronic package outside the window to a radiotelephone inside the vehicle. It may be unacceptable to cut holes in the widow or other parts of the vehicle body. The running of coaxial cables through doorjambs may not be acceptable. Accordingly, although outdoor antenna units that combine an antenna and an electronic package have been used in the trucking industry or in marine applications (such as the INMARSAT-C system), it may be generally undesirable for terrestrial cellular and satellite radiotelephone communications systems such as the Iridium, Globalstar and ACeS systems.

It is also known to allow a radiotelephone antenna to be used within an enclosure such as a building or a vehicle.

While this solution may be acceptable for many cellular radiotelephone communications, it may not be desirable for satellite radiotelephone communications which may have low link margins and which preferably operate in a direct line of sight path between the radiotelephone and the communications satellite.

SUMMARY OF THE INVENTION

It is therefore an object of the present invention to provide improved systems and methods for coupling antennas to radiotelephones through a window.

It is another object of the present invention to provide systems and methods for coupling antennas to radiotelephones through a window that need not expose an electronic package to external vulnerabilities.

It is yet another object of the present invention to provide improved systems and methods for coupling antennas to radiotelephones through a window that can provide enhanced operation in low link margin communications. These and other objects are provided, according to the present invention, by coaxially coupling signals from an antenna outside a window through the window, and amplifying the signals adjacent and inside the window. The amplified signals are then provided to a radiotelephone remote from the window. By coaxially coupling the signals from the antenna through the window, high performance coupling may be provided from outside the window to inside the window. By amplifying the signals adjacent and inside the window, high performance may be obtained in low link margin situations, without the need to expose an electronic module to external vulnerabilities.

Systems according to the invention include a through-the-window coaxial coupler that coaxially couples Radio Frequency (RF) signals between the inside and outside surfaces of the window. The through-the-window coaxial coupler includes an inside portion that mounts on the inside surface of a window, and an outside portion that mounts on the outside surface of the window and couples to an outside antenna. An inside electronic package couples to the inside portion of the through-the-window coaxial coupler, and is located adjacent the inside portion and remote from the radiotelephone. The inside electronic package includes a receive amplifier that amplifies RF signals that are received from the outside antenna via the through-the-window coaxial coupler and that provides the RF signals so amplified to the radiotelephone.

In one embodiment, the electronic package also includes a transmit amplifier that amplifies second RF signals that are received from the radiotelephone and that provides the second RF signals so amplified to the antenna via the through-the-window coaxial coupler. The receive amplifier is preferably a low noise amplifier and the transmit amplifier is preferably a power amplifier. The inside electronic package may also include a switching system that switches between the receive amplifier and the transmit amplifier in response to the radiotelephone, to provide transmit and receive operations. The inside electronic package may also include a controller that controls the switching system in response to the radiotelephone.

In another embodiment, the inside electronic package may include a wireless transceiver that wirelessly transmits and receives signals to and from a radiotelephone. Thus, only power may need to be supplied to the inside electronic package, but signal and/or control connections may be provided to the radiotelephone using wireless communications. One such wireless communications protocol that may be used is the well known "Bluetooth" protocol that defines a universal radio interface in the 2.45 GHz frequency band that enables wireless electronic devices to connect and communicate wirelessly via short-range, ad hoc networks. In this embodiment, some or all elements of a radiotelephone may be provided in the inside electronic package adjacent the inside portion of the coupler. Signals are then wirelessly relayed to a Bluetooth-compatible wireless electronic device that can provide a user interface.

Through-the-window coaxial couplers and coaxial coupling methods according to the invention preferably include an inside portion that mounts on the inside surface of the window and an outside portion that mounts on the outside surface of the window. The inside portion preferably includes a first center plate and a first surrounding plate, and the outside portion preferably includes a second center plate and a second surrounding plate. The first and second center plates are adjacent one another with the window therebetween and the first and second surrounding plates are adjacent one another with the window therebetween. Preferred embodiments of coaxial coupling systems and methods are described in application Ser. No. 09/248,887 entitled "Systems and Methods for Coaxially Coupling An Antenna Through An Insulator" to the present inventor, filed Feb. 11, 1999, assigned to the assignee of the present application, the disclosure of which is hereby incorporated herein by reference.

Accordingly, signals to and from an antenna may be efficiently coupled through the window using coaxial couplers, which are coupled to an inside electronic package adjacent the window and remote from the radiotelephone. The inside electronic module may be connected to the radiotelephone using a coaxial cable and one or more control cables, or may be wirelessly connected to the radiotelephone. Accordingly, high performance systems and methods may be provided by coaxially coupling an antenna to a radiotelephone through a window and amplifying signals adjacent and inside the window.

DETAILED DESCRIPTION OF PREFERRED EMBODIMENT

Figure 1:
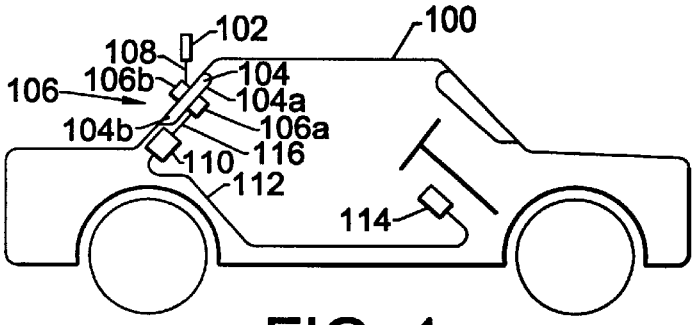
FIG. 1 illustrates systems and methods for coaxially coupling an antenna to a radiotelephone through a window by amplifying signals adjacent and inside the window according to the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the size of regions may be exaggerated for clarity. Like numbers refer to like elements throughout.

Referring now to FIG. 1, systems and methods for coaxially coupling an antenna to a radiotelephone through a window by amplifying signals adjacent and inside the window according to the invention will now be described. As shown in FIG. 1, an outside antenna 102 is provided outside an enclosure such as a vehicle 100. However, it will be understood that the enclosure may also be a building, as will be described below. It will also be understood that more than one antenna may be provided, as will be described below. The outside antenna 102 outside the vehicle 100 is coupled to a radiotelephone 114 inside the vehicle 100 using a through-the-window coaxial coupler 106 and an inside electronic package 110. The through-the-window coaxial coupler 106 coaxially couples Radio Frequency (RF) signals between the inside surface 104*a* and outside surface 104*b* of the window 104. The through-the-window coaxial coupler 106 includes an inside portion 106*a* that mounts on the inside surface 104*a* and an outside portion 106*b* that mounts on the outside surface 104*b*. The outside portion 106*b* is coupled to the outside antenna 102 either directly or via a coupling shaft 108 that can include a coaxial cable between the outside portion 106*b* and the outside antenna 102. A preferred design of a coaxial coupler 106 will be described in detail below.

Still continuing with the description of FIG. 1, an inside electronic package 110 couples the inside portion 106*a* to a radiotelephone 114, and is located adjacent the inside portion 106*a* and remote from the radiotelephone 114. As will be described in detail below, the electronic package preferably includes a receive amplifier that amplifies RF signals that are received from the outside antenna 102 via the through-the-window coaxial coupler 106 and that provides the RF signal so amplified to the radiotelephone 114. The electronic package also may include a transmit amplifier that amplifies RF signals from the radiotelephone 114 before being passed through the coaxial coupler. The transmit amplifier may raise the transmitted power from the outside antenna 102 to desired levels, as is well known in the art.

In FIG. 1, a first cable 116 is used to couple the inside portion 106*a* and the inside electronic package 110, and a second cable 112 is used to couple the electronic package 110 and the radiotelephone 114. The first cable 116 preferably comprises coaxial cable and the second cable 112 preferably comprises coaxial cable. It will be understood that the first cable 116 may be omitted and the internal electronic package 110 may be formed integral with the inside portion 106*a*. Alternatively, cables other than coaxial cable may be used to couple the inside portion 106*a* to the electronic module 110. Moreover, the second cable 112 may also include a control cable to couple the inside electronic package 110 and the radiotelephone 114 and/or a power cable to supply power to the inside electronic package 110. Alternatively control and/or power may be provided via the coaxial cable. In yet another alternative, described in detail below, a wireless connection may be provided between the inside electronic package 110 and the radiotelephone 114.

Figure 2:
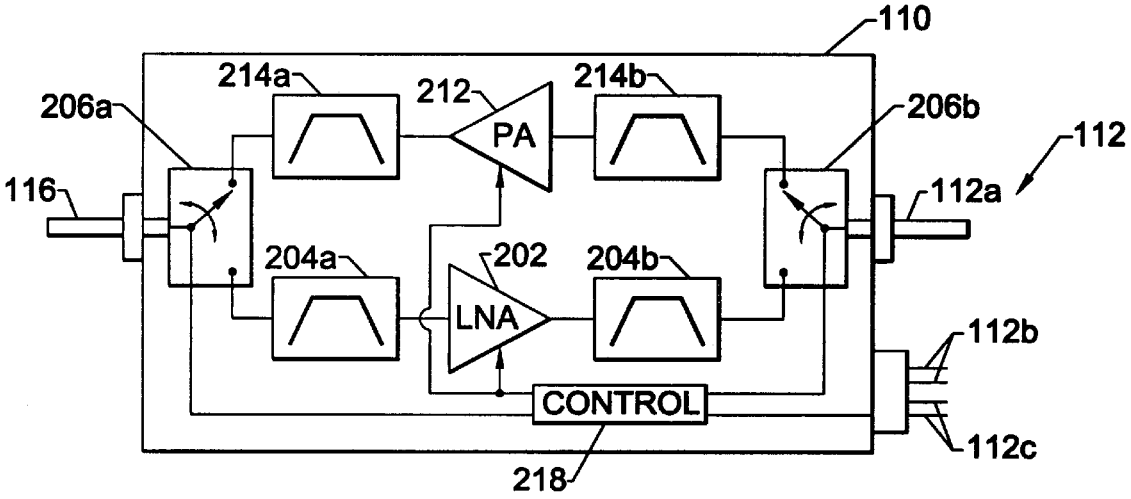
FIG. 2 is a block diagram of an embodiment of an inside electronic package of FIG. 1.

FIG. 2 is a block diagram of an embodiment of an inside electronic package 110 according to the present invention. As shown in FIG. 2, the inside electronic package 110 includes a receive amplifier such as a Low Noise Amplifier (LNA) 202 that amplifies RF signals that are received from the outside antenna 102 via the through-the-window coaxial coupler 106 and the first cable 116, and provides the RF signals so amplified to the radiotelephone 114. Associated filters 204*a* and 204*b* may be provided as is well known to those having skill in the art.

The inside electronic package 110 may also include a transmit amplifier such as an RF power amplifier 212 that amplifies second RF signals that are received from the radiotelephone 114 and that provide the second RF signals so amplified to the antenna 102 via the through-the-window coaxial coupler 106. Associated filters 214*a*, 214*b* may be provided as is well known to those skilled in the art. By including the transmit amplifier 212, precise control of transmit power may be obtained.

As also shown in FIG. 2, the inside electronic package 110 may include a switching system including two switching elements 206*a*, 206*b* that switch between the low noise amplifier 202 and the power amplifier 212 to provide half duplex communications, under control of a controller 208 that is responsive to the radiotelephone 114. By including the controller 208, precise timing of transmit bursts may be obtained. Finally, as shown in FIG. 2, the second cable 112 between the radiotelephone 114 and the inside electronic module 110 may include a coaxial cable 112*a* that carries the RF signals, one or more power cables 112*b* that provides power to the power consuming elements of the inside electronic package and one or more control signal cables 112*c* that can be applied to the controller 208.

Figure 3:
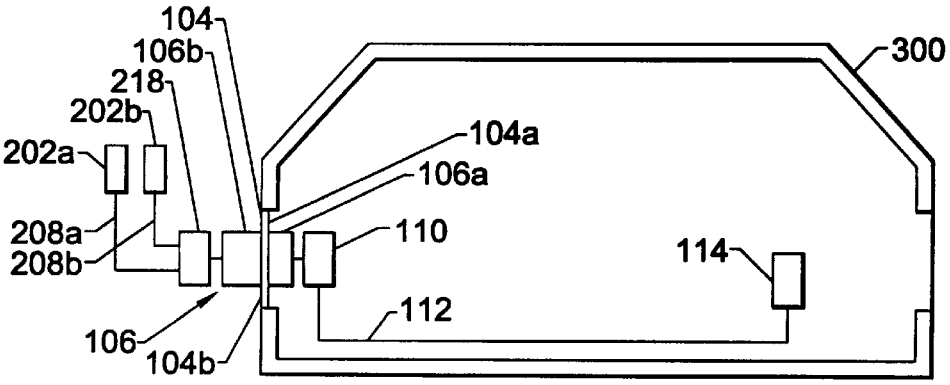
FIG. 3 illustrates systems and methods according to the present invention, wherein the enclosure is a building.

FIG. 3 illustrates systems and methods according to the present invention, wherein the enclosure is a building 300. As shown in FIG. 3, a through-the-window coaxial coupler 106 coaxially couples RF signals between the inside and outside surfaces 104*a* and 104*b* respectively of a window 104. The through-the-window coaxial coupler 106 includes an inside portion 106*a* that mounts on the inside surface 104*a*, and an outside portion 106*b* that mounts on the outside surface 104*b*. In FIG. 3, a duplexer 218 is included outside the window 104 so that the coaxial coupler 106 may be coupled to more than one antenna 202*a*, 202*b* via coupling shafts 208*a*, 208*b* respectively. For example, the antenna 202*a* may be a transmit antenna, and the antenna 202*b* may be a receive antenna. The design of the duplexer 208 to couple to multiple antennas 202*a*, 202*b* is well known to those having skill in the art, and need not be described further herein. The coaxial coupler can provide a single port connection that can facilitate the use of a duplexer 218 to provide a multiport connection to multiple antennas 202*a*, 202*b*.

Finally, as shown in FIG. 3, an inside electronic package 110 is coupled to the inside portion 106*a*, and is also coupled to a radiotelephone 114 via the second cable 112. The design of the inside electronic package 110 may be similar to that of FIG. 2, and need not be described again.

Figure 4:
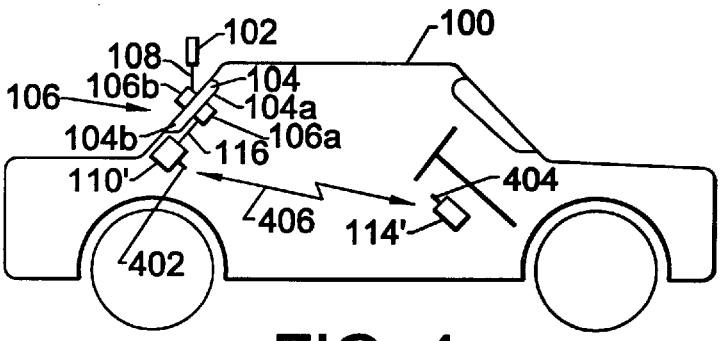
FIG. 4 illustrates another embodiment of systems and methods that coaxially couple an outside antenna to a radiotelephone through a window according to the present invention.

Referring now to FIG. 4, another embodiment of systems and methods that coaxially couple an outside antenna to a radiotelephone through a window according to the present invention is illustrated. As shown in FIG. 4, the link between the inside electronic package 110' and the radiotelephone 114' is a wireless link 406 using a first antenna 402 on the internal electronic package 110' and a second antenna 404 on the radiotelephone 114'. Accordingly, only a power connection may need be provided to the wireless inside electronic package 110'. Control and signal connections may be provided via the wireless link 406.

The wireless inside electronic package 110' may contain amplifiers, filters, switches and control circuits similar to that described in connection with FIG. 2. However, rather than a second cable 112, a short-range radio frequency transceiver may be used. In this embodiment, the radiotelephone 114' may be a conventional cellular satellite or other radiotelephone. Alternatively, the radiotelephone 114' may be a short range radiotelephone such as a cordless radiotelephone or a short range transceiver operating under Bluetooth protocol as will be described in detail below.

In a preferred aspect of the wireless inside electronic package 110', all of the mobile transceiver RF circuits, digital signal processing circuits and control processor circuits may be included in the wireless inside electronic package 110'. Then, the radiotelephone 114' may be any kind of wireless electronic device, such as a laptop computer or a fax machine, as well as a cellular telephone or a cordless telephone. The radiotelephone 114' may be a wireless input/output electronic device that includes a microphone, speaker and/or data port. It will also be understood that the wireless link 406 may use infrared or other forms of wireless links.

Figure 5:
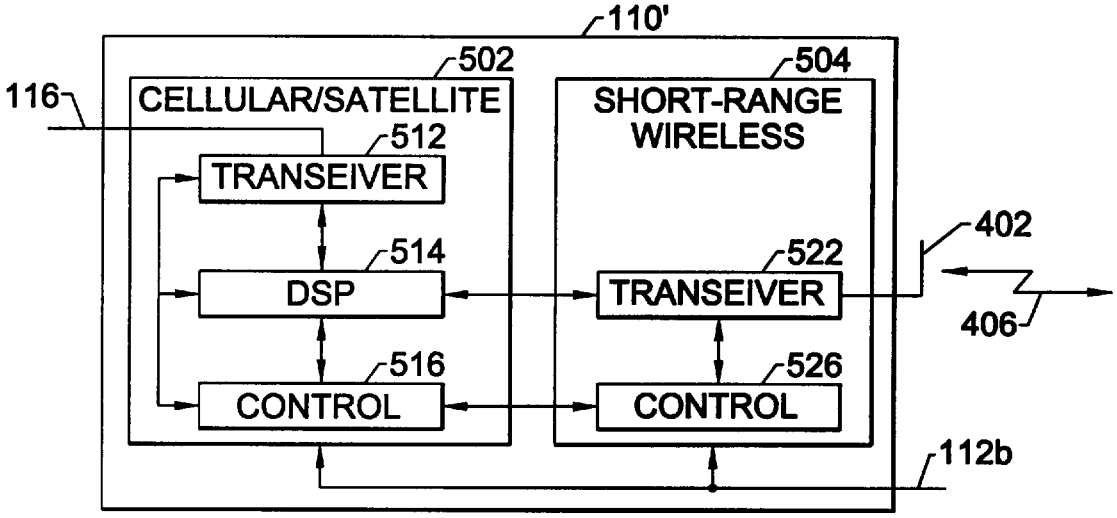
FIG. 5 is a block diagram of an embodiment of a wireless inside electronic package according to the present invention.

FIG. 5 is a block diagram of an embodiment of a wireless inside electronic package 110' that uses wireless technology to transmit and receive external radiotelephone signals to and from the radiotelephone. As shown in FIG. 5, the wireless inside electronic package 110' includes a cellular/satellite portion 502 and a short-range wireless portion 504.

The cellular/satellite portion 502 may include a cellular/satellite transceiver 512, a Digital Signal Processor (DSP) 514 and a controller 516, such as a microprocessor controller. The transceiver is coupled to inner portion 106*a* of the coaxial coupler 106 via the first cable 116. It will be understood by those having skill in the art that the cellular/satellite portion 502 preferably is compatible with the cellular/satellite system that is being interfaced to, via the outside antenna 102.

The short-range wireless portion 504 can include a short-range wireless transceiver 522 and a controller 526. The short-range wireless transceiver 522 transmits and receives messages to and from the radiotelephone 114' via the first antenna 402 and the wireless link 406.

The short-range wireless portion 504 can control the cellular/satellite portion 502. The short-range wireless transceiver may be an infrared transceiver or a cordless RF transceiver, such as are used with cordless telephones. In a preferred embodiment, the short-range wireless portion includes a Bluetooth transceiver. As is well known to those having skill in the art, Bluetooth technology provides a universal radio interface in the 2.45 GHz frequency band that enables portable electronic devices to connect and communicate wirelessly via short-range ad hoc networks. Bluetooth technology is described for example in Haartsen, "*Bluetooth—The Universal Radio Interface for Ad Hoc, Wireless Connectivity*", Ericsson Review No. 3, 1998, pp. 110–117, the disclosure of which is hereby incorporated herein by reference. This type of protocol may be used for individuals in a conventional passenger vehicle, as well as taxi service, limousine service, and including bus and other multi-unit enclosures.

A preferred embodiment of a through-the-window coaxial coupler 106 according to the present invention will now be described. Additional details may be found in application Ser. No. 09/248,887, entitled "Systems and Methods for Coaxially Coupling An Antenna Through An Insulator" to the present inventor, filed Feb. 11, 1999, assigned to the assignee of the present application, the disclosure of which is hereby incorporated herein by reference.

Figure 6A:
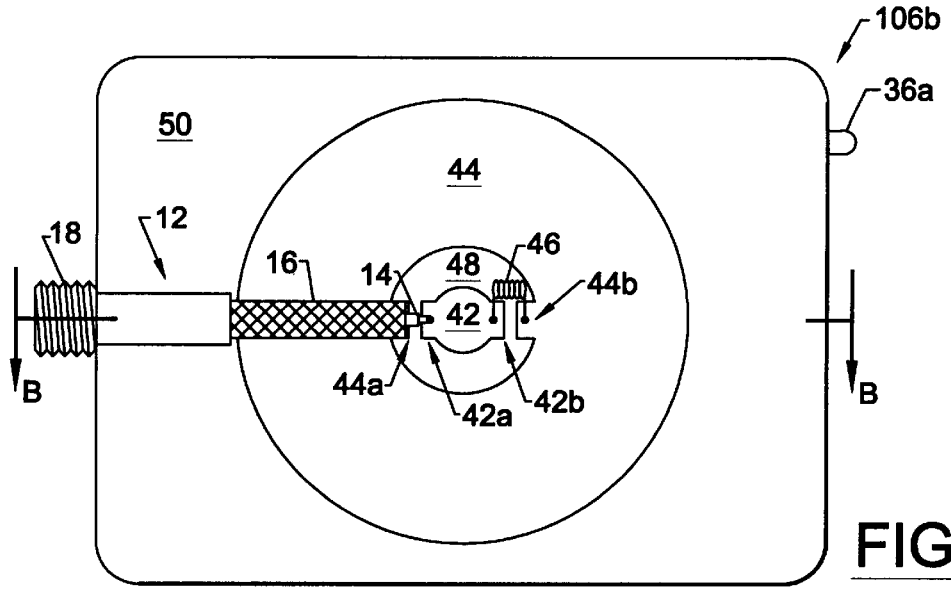
FIGS. 6A, 6B and 6C are a top view, cross-sectional view and bottom view respectively, illustrating systems and methods for coupling an outside coaxial cable to an inside coaxial cable through a window according to the present invention.
Figure 6B:
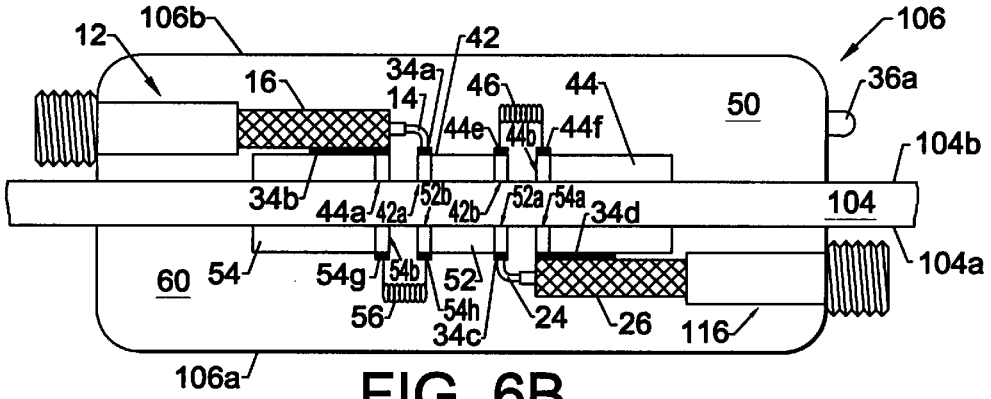
Figure 6C:
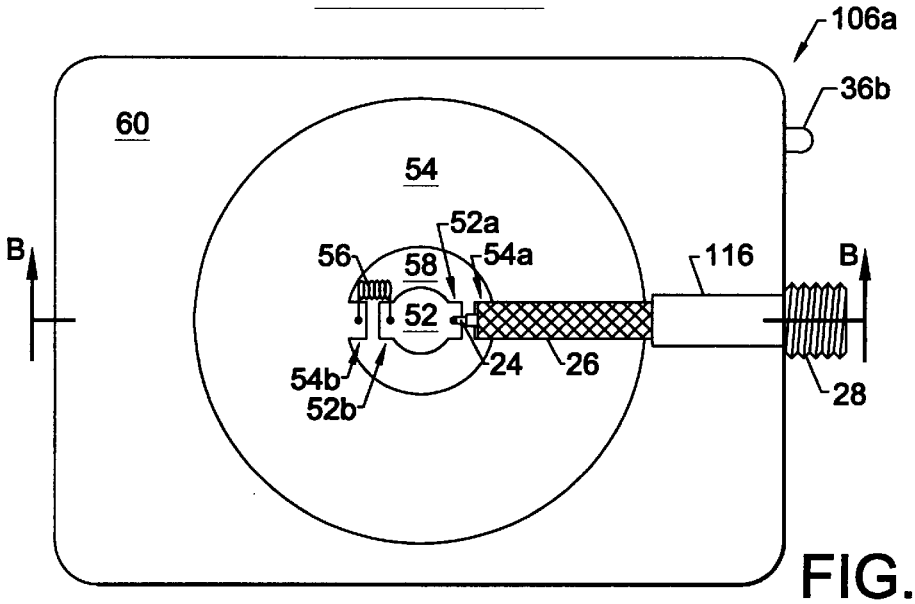

FIGS. 6A, 6B and 6C are a top view, cross-sectional view and bottom view, respectively, of systems and methods for coupling a first coaxial cable to a second coaxial cable through an insulator. As shown in FIGS. 6A–6C, coupling systems and methods 106 couple an outside coaxial cable 12 that includes a first inner conductor 14 and a first shield conductor 16 to a first coaxial cable 116 including a second inner conductor 24 and a second shield conductor 26, through a windshield or other window 104 that includes outside and inside window surfaces 104*a* and 104*b* respectively. As is well known to those having skill in the art, each coaxial cable also may include an inner insulator and an outer jacket.

A first center plate 42 and a first surrounding plate 44 are adapted for attachment to the outside window surface 104*b* using adhesive, fasteners and/or other conventional attaching means, such that the first surrounding plate 44 surrounds the first center plate 42 on the outside surface 104*b*. The first center plate 42 is electrically connected to the first inner conductor 14 using solder 34*a* and/or other conventional electrical connecting means. The first surrounding plate 44 is electrically connected to the first shield conductor 16 using solder 34*b* and/or other conventional electrical connecting means.

A second center plate 52 and a second surrounding plate 54 also are adapted for attachment to the inside window surface 104*a* using adhesive, fasteners and/or other conventional attaching means such that the second surrounding plate 54 surrounds the second center plate 52 on the inside window surface 104*a*. As shown, the first and second center plates 42 and 52 respectively are adjacent one another with the window 104 therebetween. Also, the first and second surrounding plates 44 and 54 are adjacent one another with the window 104 therebetween. The second center plate 52 is electrically connected to the second inner conductor 24 using solder 34*c* and/or other conventional electrical connecting means. The second surrounding plate 54 is electrically connected to the second shield conductor 26 using solder 34*d* and/or other electrical connecting means.

As shown in FIGS. 6A–6C, the first and second center plates 42 and 52 respectively, preferably are first and second disks. The first and second surrounding plates 44 and 54 respectively, preferably are first and second rings. As also shown in FIGS. 6A–6C, the first and second rings 44 and 54 respectively, preferably are first and second continuous rings. However, polygonal shaped center plates and surrounding plates, including but not limited to square shaped center plates and surrounding plates may be used, and gaps may be present in the center plates and/or surrounding plates so that they are not continuous.

A first inductor 46 is electrically connected between the first center plate 42 and the first surrounding plate 44 using solder 44*e*, 44*f* and/or other conventional electrical connecting means. A second inductor 56 is electrically connected between the second center plate 52 and the second surrounding plate 54 using solder 54*g*, 54*h* and/or other conventional electrical connecting means. More than one inductor also may be electrically connected between a center plate and a surrounding plate as will be described below.

The coaxial cables 12 and 116 and the inductors 46 and 56 may be electrically connected to the center plates and surrounding plates at any arbitrary position thereon. However, preferably, they are connected as illustrated in FIGS. 6A–6C to reduce and preferably minimize unwanted couplings and parasitics. More specifically, the first inner conductor 14 preferably is electrically connected to the first center plate 42 at a first position 42*a* thereon and the first inductor 46 preferably is electrically connected to the first center plate 42 at a second position 42*b* that is remote from the first position. The second inner conductor 24 preferably is electrically connected to the second center plate 52 at a first position 52*a* thereon and the second inductor 56 preferably is electrically connected to the second center plate 54 at a second position 52*b* that is remote from the first position 52*a*. Moreover, the first position 42*a* on the first center plate 42 preferably is adjacent the second position 52*b* on the second center plate 52. The second position 42*b* on the first center plate 42 preferably is adjacent the first position 52*a* on the second center plate 52.

The first shield conductor 16 preferably is electrically connected to the first surrounding plate 44 at a first position 44*a* thereon. The second shield conductor 26 preferably is electrically connected to the second surrounding plate 54 at a second position 54*a* thereon that is remote from, and preferably opposite, the first position 44*a* on the first surrounding plate 44. Moreover, the first inductor 46 preferably is electrically connected to the first surrounding plate 44 at a second position 44*b* that is remote from, and more preferably opposite, the first position 44*a*. The second inductor 56 is preferably connected to the second surrounding plate 54 at a second position 54*b* that is remote from, and more preferably opposite, the first position 54*a*. Thus, as shown, the first and second coaxial cables preferably emerge from opposite directions and the first inductors preferably are located remote from one another.

As also shown in FIGS. 6A–6C, the first center plate 42 and the first surrounding plate 44 preferably define a first gap 48 therebetween and the second center plate 52 and the second surrounding plate 54 preferably define a second gap 58 therebetween. The first shield conductor 16 preferably extends into the first gap and the second shield conductor 26 preferably extends into the second gap 58. More preferably, as shown, the first shield 16 preferably extends midway into the first gap 48 and the second shield 26 preferably extends midway into the second gap 58.

Still referring to FIGS. 6A–6C, the first and second positions on each of the first center plate 42, first surrounding plate 44, second center plate 52 and second surrounding plate 54 may be defined using a tab such as a projecting tab. The tab can facilitate solder connection at the appropriate place on the center plates and surrounding plates. The tabs may be raised and may have a shape that enhances soldering. Multiple layers may be used for the tabs. However, it will be understood that the first and second positions on each of the center plates and surrounding plates need not be defined by specific features such as tabs.

Finally, a first housing 50 contains the first center plate 42 and the first surrounding plate 44. A second housing 60 contains the second center plate 52 and the second surrounding plate 54. The first housing 50 also may contain the outside coaxial cable 12 and a first coaxial cable connector 18. Similarly, the second housing 60 may also contain the first coaxial cable 116 and a second coaxial cable connector 28. It will be understood however, that the coaxial cable connectors 18 and 28 need not be contained within or be adjacent the housings, and may be eliminated entirely. Similarly, the coaxial cables 12 and 116 themselves may be outside the housings 50 and 60.

In order to facilitate alignment of the first housing 50 and the second housing 60 to one another on opposite surfaces of the window 104, an alignment key such as a pair of dimples 36*a*, 36*b* may be provided on a respective housing 50 and 60. Alternatively, alignment keys 36*a*, 36*b* may be painted or otherwise inscribed on the housings 50 and 60 and also may be provided by virtue of the overall shape of the housings 50 or 60. Alternatively, alignment keys need not be provided at all.

The materials and dimensions of the center plates, surrounding plates, inductors and housings may be varied depending on a particular application. However, the center plates and surrounding plates preferably comprise stamped copper and the housing preferably comprises plastic. The surrounding plates may have an outer diameter of about 45 mm and an inner diameter of about 20 mm. The center plate may have a diameter of about 15 mm so that a 2.5 mm gap is present. The plates may be less than 1 mm thick. The housings should preferably maintain a clear area above and below of about 1 cm. The inductors may be meandering line inductors rather than coils.

Figure 7A:
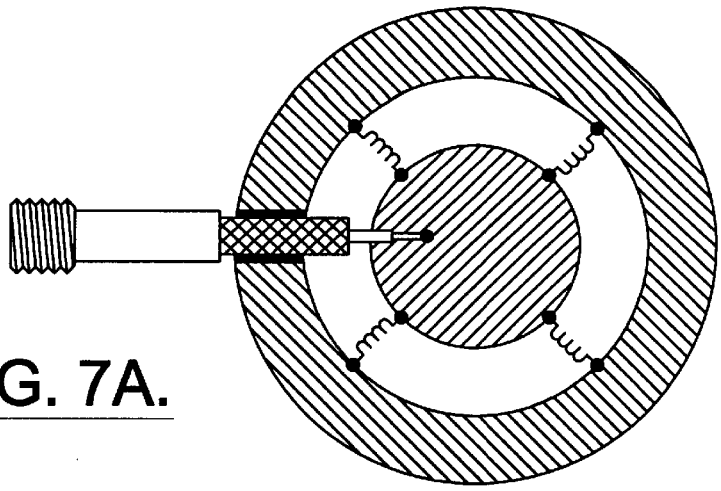
FIGS. 7A–7C illustrate alternative arrangements of coaxial coupling systems and methods according to the present invention.
Figure 7B:
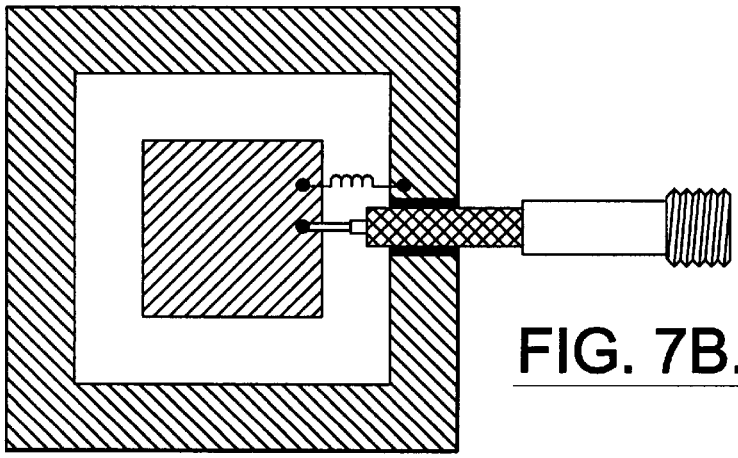
Figure 7C:
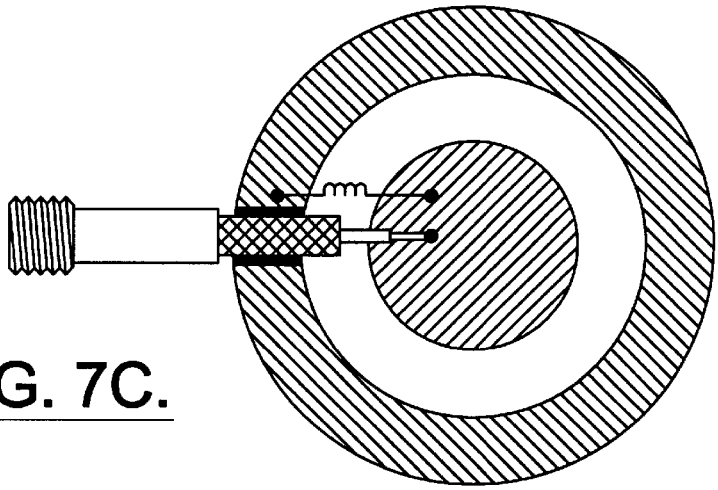

It will be understood that more than one inductor may be used to couple a respective center plate to a respective surrounding plate. Alternative arrangements of center plates, surrounding plates, and positioning of coaxial cables and inductors are shown in FIGS. 7A–7C. The inductance may be distributed to reduce the difficulty of fabricating small inductor values. Thus, for example, four-20 nH coils may be used to achieve a 5 nH coil.

Figure 8A:
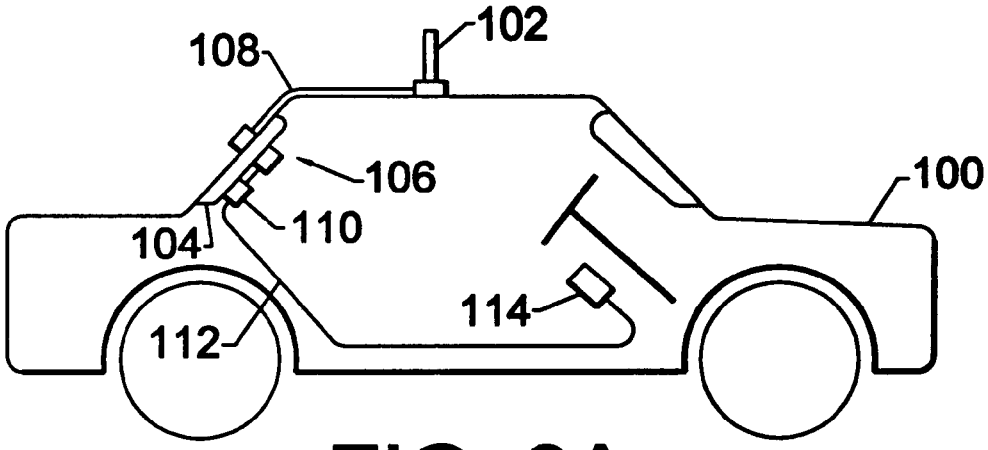
FIGS. 8A–8B illustrate the use of coupling systems and methods according to the present invention to couple an antenna on the outside of a vehicle to a radiotelephone inside a vehicle.
Figure 8B:
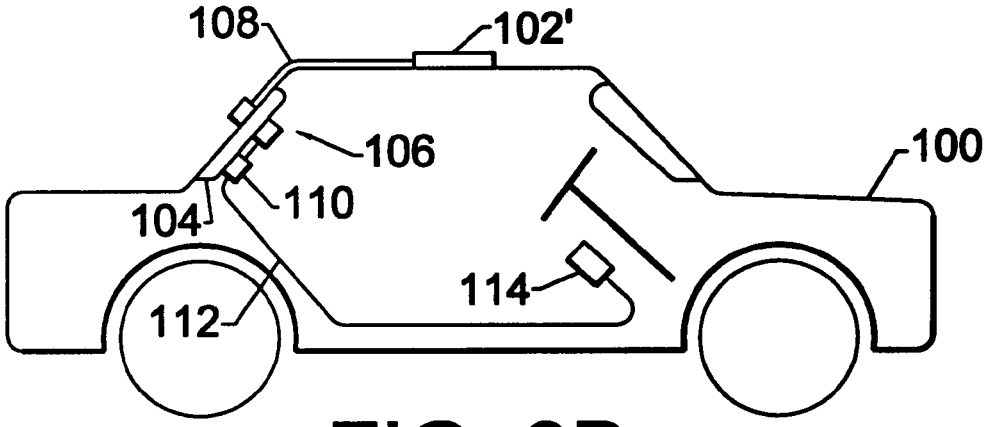

FIGS. 8A–8C illustrate the use of coupling systems and methods according to the present invention to couple an antenna on the exterior of a vehicle to a radiotelephone within a vehicle. As shown in FIG. 8A, coupling 106 is used to couple a first coaxial cable 108 that is connected to an antenna such as a quadrifilar helical antenna 102 on the roof of a vehicle 100, through the rear window 104 of the vehicle 100, to a second coaxial cable 112 that itself is coupled to a radiotelephone 114 within the vehicle 100. FIG. 8B illustrates a similar embodiment to FIG. 8A except that a patch antenna 102' is used on the roof of the vehicle 100. It will be understood that other antennas may be used and other mounting positions for couplers, antennas and transceivers such as radiotelephones may be used. Coupling through windows other than the rear windshield also may be used.

As described above, the present invention may be used to coaxially couple two or more conductors through a window. A two-conductor circuit can provide for signal excitation and signal return to complete a circuit. This is known as a "single-port". Components having input ports and output ports, known as "two ports" or "multiports" may be cascaded from single ports to modify the signal delivered to the output ports. Examples of such two-ports are transmission lines, duplexers, filters, as well as quadrature matching networks. A low loss, two conductor coupling according to the invention can enable these above-referred components to become part of the external network.

As also described above, the electronic package preferably contains a low noise amplifier 202. A figure of merit of a radiotelephone to receive signals from an earth orbiting satellite may be determined principally by the ratio of the antenna gain to the receiver system noise temperature. The receiver system noise temperature is the sum of the receiver noise temperature and the antenna noise temperature. Generally, the reference point for assessing this ratio is at the input terminals of the receiver system. When the antenna is separated from the receiver by a transmission line, the transmission line losses are generally included in the antenna temperature according to known formulas, which are described for example in Chapter 17, section 3 of "*Antennas, Second Edition*", by John D. Kraus, McGraw-Hill, 1988. The present invention can use this theory in a manner advantageous to mobile communication transceivers used for communication with earth orbiting communication satellites to conveniently satisfy the cable routing requirements while reducing and preferably minimizing the external exposed cabling outside the vehicle.

Accordingly, the present invention can provide efficient coupling from an outside antenna to an inside radiotelephone through a window. Moreover, the invention can provide enabling technology that can allow other products to be used in vehicular and/or building environments that may have been too awkward to have been used in the past.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A system that couples an outside antenna to a radiotelephone through a window including an outside surface and an inside surface, the system comprising:

a through-the-window coaxial coupler that coaxially couples Radio Frequency (RF) signals between the inside and outside surfaces of the window, the through-the-window coaxial coupler including an inside portion that mounts on the inside surface and an outside portion that mounts on the outside surface and couples to the outside antenna; and an inside electronic package including a coaxial cable connector that couples the inside portion to a radiotelephone via a coaxial cable, the inside electronic package being located adjacent the inside portion and remote from the radiotelephone, the inside electronic package comprising a receive amplifier that amplifies RF signals that are received from the outside antenna via the through-the-window coaxial coupler, and that provides the RF signals so amplified to the radiotelephone via the coaxial cable connector, and a transmit amplifier that amplifies second RF signals that are received from the radiotelephone via the coaxial cable connector and that provides the second RF signals so amplified to the antenna via the through-the-window coaxial coupler.

2. A system according to claim 1 wherein the inside electronic package further comprises a switching system that switches between the receive amplifier and the transmit amplifier in response to the radiotelephone.

3. A system according to claim 2 wherein the inside electronic package further comprises a controller that controls the switching system in response to the radiotelephone.

4. A system according to claim 1 further comprising a duplexer that is coupled to the outside portion and that couples to the outside antenna and at least a second outside antenna.

5. A system according to claim 1 further comprising a control cable that couples the inside electronic package to the radiotelephone.

6. A system according to claim 1 wherein the window is a vehicle window.

7. A system according to claim 1 wherein the window is a building window.

8. A method for coupling an antenna to a radiotelephone comprising the steps of:

coaxially coupling signals from the antenna through a window;

amplifying the coaxially coupled signals adjacent the window;

coupling the amplified signals to a radiotelephone remote from the window over a coaxial cable;

coupling second signals from the radiotelephone to adjacent the window over the coaxial cable;

amplifying the second signals adjacent the window;

coaxially coupling the amplified second signals through the window; and coupling the amplified second signals through the window to the antenna.

9. A method according to claim 8:

wherein the antenna comprises first and second antenna elements;

wherein the step of coaxially coupling signals from the antenna through a window comprises the step of coaxially coupling signals from the first antenna element through-the-window; and wherein the step of coupling the amplified second signals through the window to the antenna comprises the step of coupling the amplified second signals through the window to the second antenna element.

10. A method according to claim 8 wherein the window is a vehicle window.

11. A method according to claim 8 wherein the window is a building window.

* * * * *